US005125668A

United States Patent [19]

Welte

[11] Patent Number: 5,125,668

[45] Date of Patent: Jun. 30, 1992

[54] GAME INVOLVING TOY VEHICLES

[76] Inventor: Gregory A. Welte, 406 E. Clark St., Apt. 3, Champaign, Ill.

[21] Appl. No.: 513,928

[22] Filed: Apr. 24, 1990

Related U.S. Application Data

[63] Continuation-in-part of Ser. No. 482,035, Feb. 20, 1990, Pat. No. 5,100,153.

[51] Int. Cl.[5] ..... A63H 30/04

[52] U.S. Cl. ..... 273/357; 124/29; 273/386; 446/456

[58] Field of Search ..... 273/357, 355, 356, 386; 446/454, 455, 456; 124/29

[56] References Cited

U.S. PATENT DOCUMENTS

| | | | |
|---|---|---|---|
| 2,279,386 | 4/1942 | Carver | 124/29 X |
| 2,474,054 | 6/1949 | Jones | 124/29 |
| 2,775,848 | 1/1957 | Isaacson | 446/436 |
| 3,065,569 | 11/1962 | Nielsen et al. | 446/88 |
| 3,103,762 | 9/1963 | Glass et al. | 446/191 |
| 3,811,675 | 5/1974 | Torgow | 273/357 |
| 4,232,865 | 11/1980 | Chen et al. | 273/386 X |

FOREIGN PATENT DOCUMENTS 3008604 3/1980 Fed. Rep. of Germany .

OTHER PUBLICATIONS

Radio Shack 1990 Catalog Jan.-1990.

Fordham 1990 Catalog Jan.-1990.

*Primary Examiner*—William H. Grieb

[57] ABSTRACT

The invention relates to a game in which an invading player sends a self-propelled vehicle into a defender's territory. The vehicle carries a gun which shoots PING-PONG ball toward a goal, after a time delay. The invader chooses the time delay such that the ball shoots when the vehicle is located at a good scoring position. In order to prevent the invader from scoring, the defender throws PING-PONG balls of his own toward the vehicle. The vehicle carries a sensor which detects ball strikes. When a ball strike occurs, the vehicle is forced to temporarily drive in reverse, or take another type of detour.

14 Claims, 9 Drawing Sheets

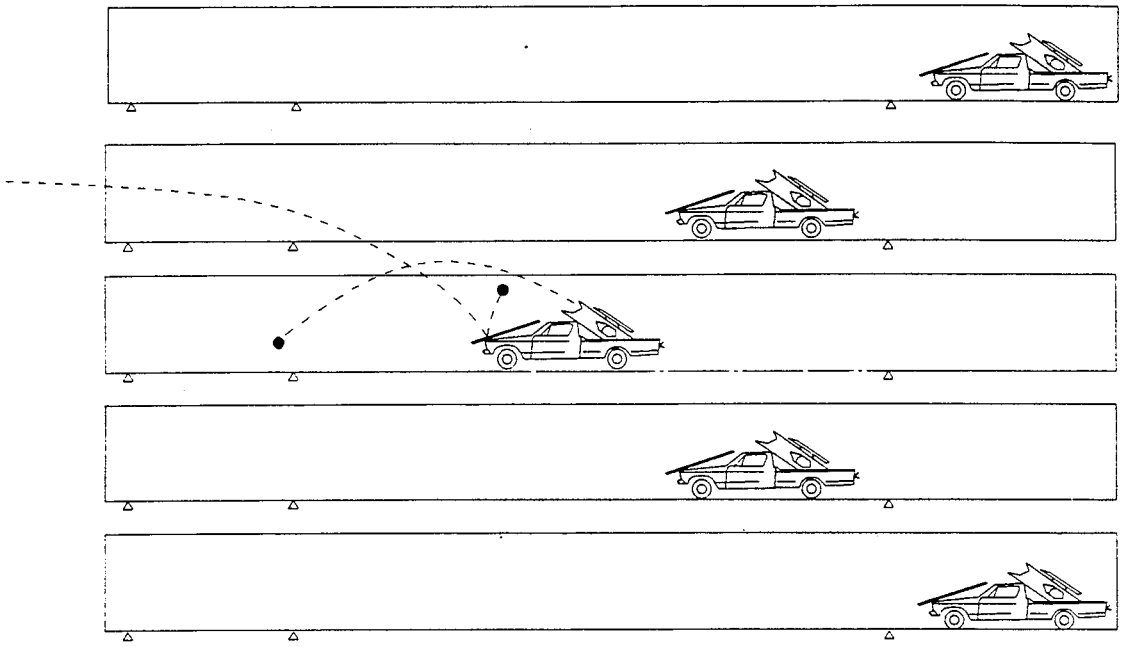
FIGURE 3
FIGURE 4
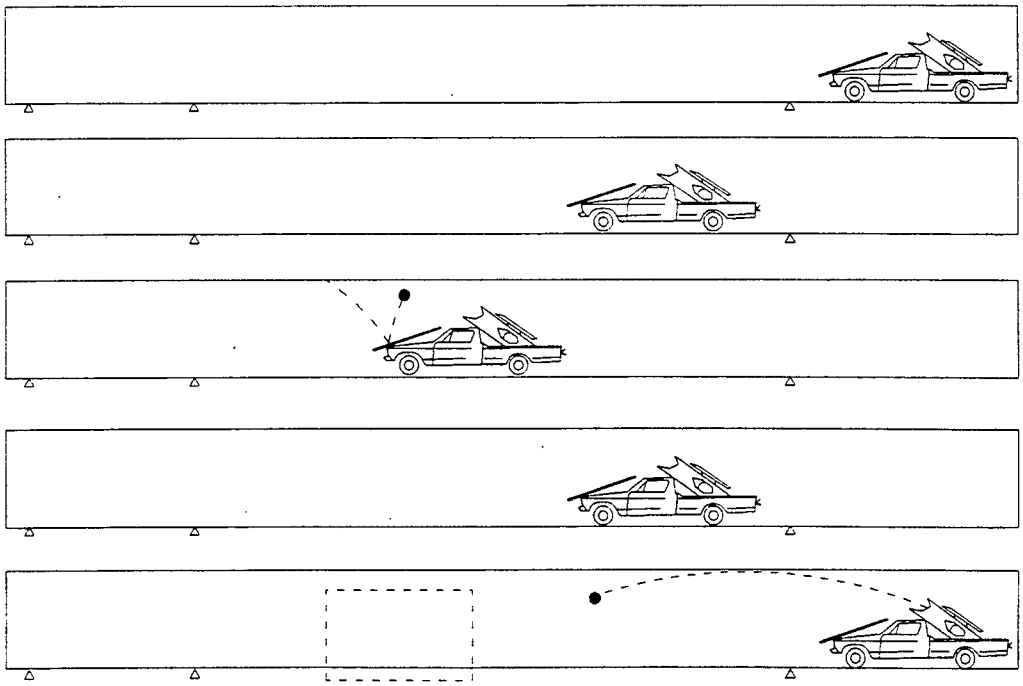

GAME INVOLVING TOY VEHICLES

This is a continuation-in-part of Ser. No. 07/482,035, filed on Feb. 20, 1990, now U.S. Pat. No. 5,100,153, granted Mar. 31, 1992, which is hereby incorporated by reference.

The invention concerns a game in which an invading player sets a timer on a self-propelled vehicle, and then sets the vehicle in motion toward a goal. When the timer expires, the vehicle shoots a PING-PONG ball. If the invader set the time correctly, the ball shoots into the goal. Meanwhile, a defender of the goal throws balls at the vehicle. If the defender strikes the vehicle, the vehicle is forced to detour from approaching the goal for a time interval.

BACKGROUND OF THE INVENTION

There exist numerous motorized toy vehicles in the prior art. Some shoot projectiles of various types. Others contain sensors which detect collisions with stationary objects, and alter the vehicle's path in response. Certain aspects of these vehicles, together with other components, can be combined to provide a game wherein strategy and acquired skill are involved.

OBJECT OF THE INVENTION

It is an object of the invention to provide a game of strategy and skill involving two or more players.

BRIEF DESCRIPTION OF THE DRAWINGS

FIGS. 2 through 5 illustrate possible sequences of events which the vehicle 3 in FIG. 1 can undertake.

DETAILED DESCRIPTION OF THE INVENTION

Figure 1:
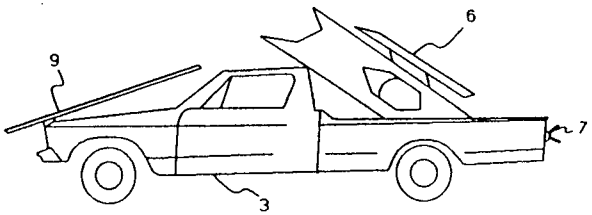
FIG. 1 illustrates a toy vehicle having a gun which shoots a PING-PONG ball, and a sensor which detects strikes by incoming PING-PONG balls.

The game comprises a self-propelled toy vehicle 3 in FIG. 1 which has one or more of several accessories. First, it can carry a cannon 6 which shoots a PING-PONG ball. Second, it can carry a programmable timer (not shown) which fires the cannon at a selected time after an invading player releases the vehicle. Third, it can carry a target 9 which detects strikes by incoming PING-PONG balls which are thrown by a defender, which inflict a penalty on the vehicle. The penalties can require the vehicle to (a) drive in reverse for a time period, (b) involuntarily shoot the ball, or (c) engage in other behavior which interferes with scoring a goal.

Fourth, the vehicle can carry a switch which allows one of the players to select the type of penalty imposed, perhaps without the knowledge of the other player. This feature will alter the strategy of the other player. Fifth, the vehicle can carry circuitry which allows a player to program it to move in a darting fashion, forward and backward (or left and right), in order to be more difficult to hit.

One object of the game is for the invader to get the vehicle close enough to a goal line to shoot the ball past the goal, but without actually crossing the goal. If the vehicle crosses the goal without shooting, he loses the round. Similarly, if his shot fails to cross the goal, he loses. While the vehicle is en route, a defender throws ping-pong balls at the vehicle in the attempt to inflict penalties, to prevent scoring goals. A sensor on the vehicle detects ball strikes, and alters the behavior of the vehicle in response, which can cause the vehicle to (a) shoot the ball at a time unexpected by the invader, or (b) take other action which penalizes the invader.

In another form or the invention, the defender has several stationary cannons which he aims in advance at selected locations. When the invader starts his scoring drive, the defender shoots each cannon at a time he selects.

Several types of game which can be played using such a vehicle will be explained, by way of example, and then one type of construction of the vehicle will be explained.

FIRST EXAMPLE, FIG. 2

Figure 2:
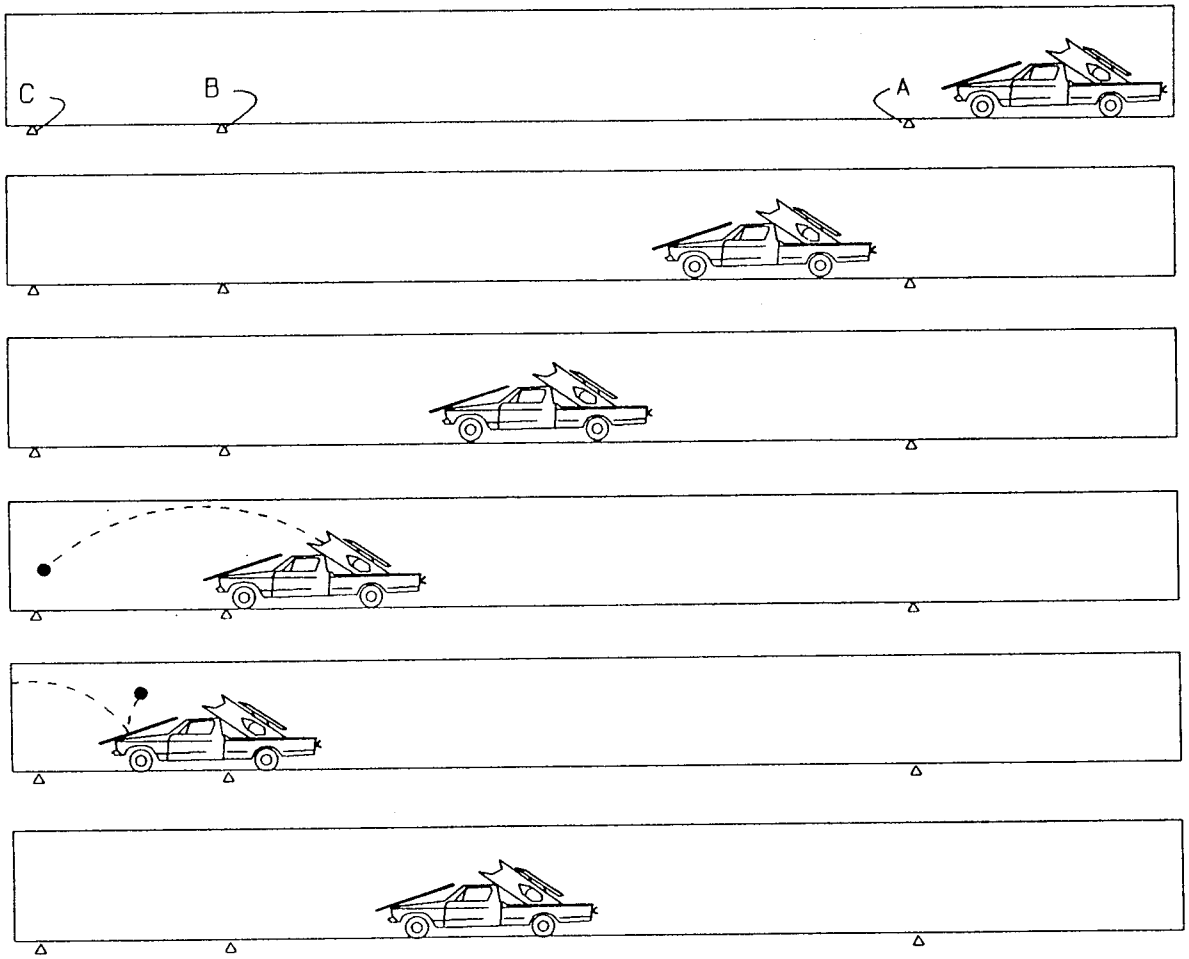

FIG. 2 shows a simple example. The vehicle is constructed such that a defensive strike causes the penalty of involuntary shooting of the cannon. (In other examples, the penalty is temporary reversal.)

The vehicle starts at point A, and the cannon is timed to fire after three seconds. The defender is located to the left of point C. The cannon's range equals the distance from point B to point C. Thus, to score a goal, the cannon must fire when located in the scoring zone located between B and C. In play, the vehicle proceeds as indicated in the first three frames of FIG. 1, and then the cannon shoots at three seconds after start-up. The invader wins this round.

Upon shooting, the vehicle automatically reverses direction and drives toward its starting point, in order to return to the invader for reloading and the start of another scoring drive.

If the defender had struck the vehicle before it reached the scoring zone, as in FIG. 3, then the defender would have won the round instead.

Therefore, in this example, the skill involved lies in the invader's ability to choose a time delay which causes shooting as close as possible to point B, and the defender's skill lies in being able to hit the moving vehicle at the relatively long distance (before the vehicle reaches point B).

SECOND EXAMPLE, FIG. 4

As a more complex example, the vehicle is now constructed so that a ball strike forces the it to reverse for a time period, such as two seconds, instead of firing the cannon. Now, the invader's strategy changes. A ball strike is no longer fatal; it only causes a detour in reaching the scoring zone.

The invader must anticipate the number of detours, and set his shot timer accordingly. For example, as in FIG. 4, assume that he chooses a shot delay of three seconds. If a single detour occurs, the vehicle will shoot as shown in the 3-second frame, and the invader loses the round. However, if the invader chose a five-second delay instead, his vehicle will be located at the phantom position shown in the 3-second frame, and he will score a goal.

In this example, the time delay chosen by the invader will depend primarily on the number of balls which the defender has in stock, and on the perceived accuracy of the defender's throws.

The preceding two examples require relatively simple strategies. Now, more complex styles of play will be introduced.

THIRD EXAMPLE

The invader can secretly choose the penalty: he can choose between cannon shooting, and a temporary reversal in direction.

The possibility of bluff now arises because the invader can control the vehicle by throwing balls at it, and the throwing gives information to the defender. For example, assume that the vehicle is moving dangerously close to the scoring zone, yet shooting time is a few seconds away. The invader can throw a ball at the vehicle, in order to cause a reversal, to consume some of the time remaining in the delay.

However, the defender can misinterpret the ball throw, as by believing that the penalty is shooting (contrary to fact), and that the invader is trying to induce a shot. If the defender falls for the bluff, he will attempt ball strikes, and if the bluff is successful, a strike will cost the defender the round.

Another type of bluff can occur if (a) the vehicle reaches the scoring zone, (b) is properly timed to shoot, and (c) the penalty chosen is shooting. If the invader throws balls at the vehicle, a strike is not beneficial, from a scoring perspective, because a successful shot would have occurred in any case, even if the defender struck the vehicle. However, a strike does serve to conceal the invader's chosen timing.

In order to ascertain the penalty chosen, the defender will throw at least one ball when the vehicle is well outside the scoring zone. The defender cannot wait until the vehicle is inside the scoring zone, because, if the penalty were shooting, a strike in the scoring zone would cost the defender the round.

FOURTH EXAMPLE

The rules are now modified. If the defender forces the invader to retreat to a specified point to the right of point A, the defender wins the round (in addition to winning in the ways described above.) That is, the defender scores a "safety."

This point of retreat can be located such that a strike immediately upon startup of the vehicle, or slightly thereafter, will drive the vehicle behind the retreat point. The defender must now decide whether to "blitz" and shower the invader with balls, in the hope of scoring a safety, or to play as usual. This new rule leads to an additional feature of the vehicle.

Now, a hit is fatal, because either a safety or a lost shot occurs, at least until the vehicle advances far enough from point A. The added feature is that the invader can secretly de-activate the strike detector for a time period which is long enough to allow the vehicle to escape the possibility of a safety (at least on a single strike).

The invader pays a price for this de-activation: the penalty is now required to be reversal, and the duration of reversal is now longer. Another type of de-activation which is possible is to allow the invader to de-activate the target 9 for a time interval, beginning at a selected time after starting.

Figure 5:
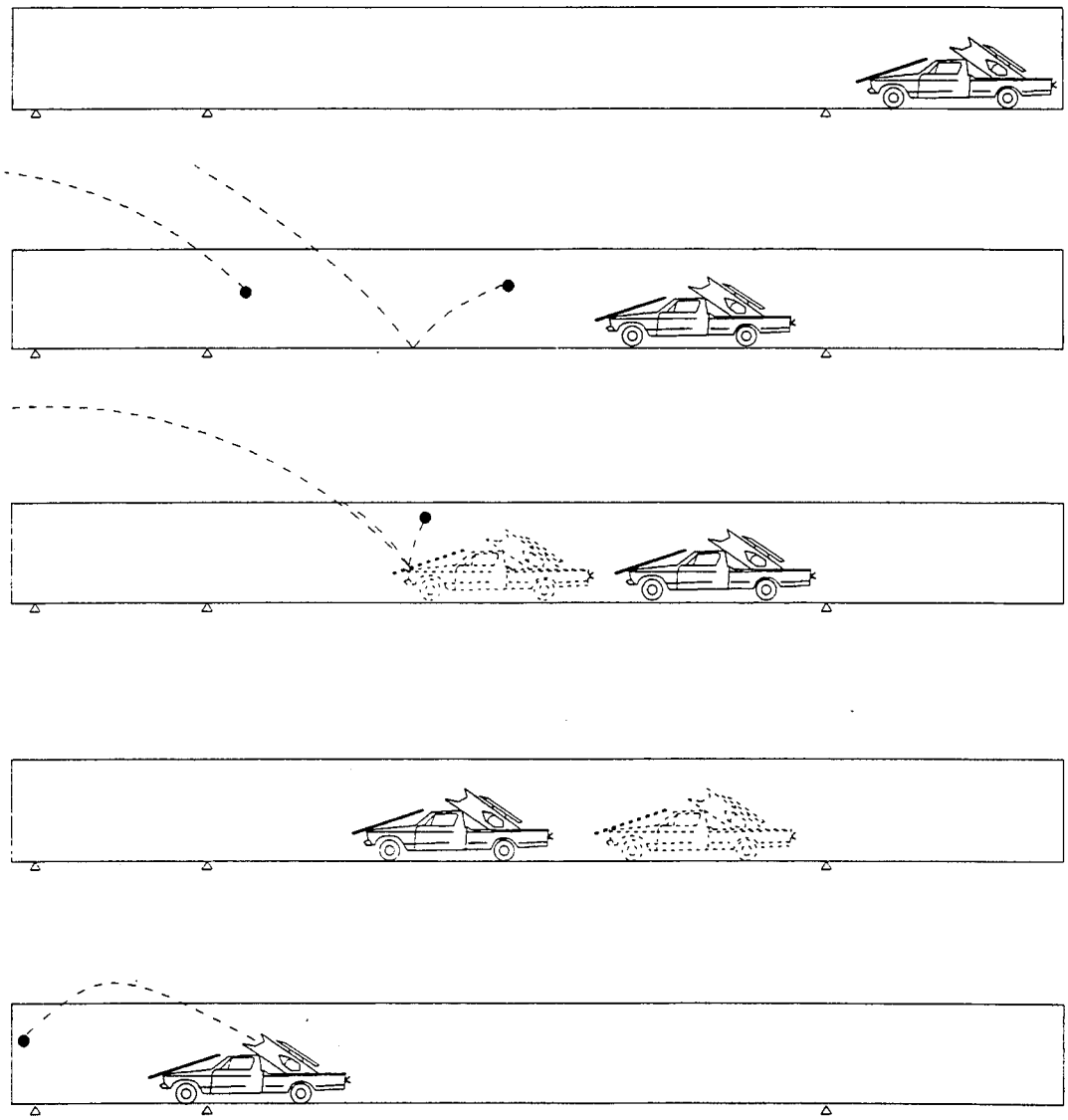

FIG. 5 [FIG. 5 illustrates another example of play, which is considered self-explanatory.

Several important aspects of the game are the following.

1. An element of randomness can be important, as when a highly skilled player plays a less experienced player. Randomness can lie in allowing the defender to choose either (a) the time delay or (b) the type of penalty, and letting the invader choose the other. The choice of each is concealed from the other, as by using switches 7 shown in FIG. 14.

2. The type of game chosen by the players will alter the strategy. For example, assume that a game consists of five scoring drives, after which the invader and defender trade positions for the following game. The defender has a total of ten balls to throw in the five rounds, and he can throw as many of them as he wishes in each round, but no more than ten total in the five rounds.

Assume that the fourth scoring drive is about to begin, and the defender has two balls left. The invader's strategy will be different than if the defender had five balls. The invader may decide to choose a three-second shot delay, in the hope that the defender will be frugal with balls. However, if he is hit, as in FIG. 3, he loses the round, but costs the defender 50 percent of his defensive balls.

3. There is a limit to the maximum possible time delay which the invader can select, which adds challenge to the game. For instance, assume that (a) the maximum delay is 10 seconds, (b) it requires three seconds for the vehicle to travel from point A to point B, and (c) a reversal lasts for two seconds. If the defender causes four detours before the vehicle reaches point B (no matter where), he wins automatically, no matter what shot delay the invader chooses (within the limit, of course). However, if the game is structured such that a game consists of five scoring runs, and the defender has only ten balls total, he will not necessarily attempt to cause four detours.

Restated, the number of balls allowed to the defender and the number of scoring drives in a game affects the strategy. For example, if the defender had unlimited balls, the invader would probably never score. Thus, the players may wish to determine the number of balls allowable and number of drives by the throw of a dice. If the defender is awarded few balls, but the invader is awarded many drives, the strategy will be different than in the converse case.

4. The game can be arranged such that only one of the players has the option to decide whether safeties are allowed during a given round. In determining which player holds the option, a flag can pass back and forth, much like the doubling cube in Backgammon. The player holding the flag has the option of allowing or disallowing safeties. For example, in odd-numbered rounds, the invader can hold the option to call for safeties.

5. The target 9 can cycle on and off periodically. A light indicates to the defender when the target 9 is sensitive.

CONSTRUCTION OF VEHICLE

The preceding discussion has described a few types of games which can be played using different forms of the invention. This discussion will now explain the construction of several apparatus which can be used to play the games.

TARGET

Figure 6:
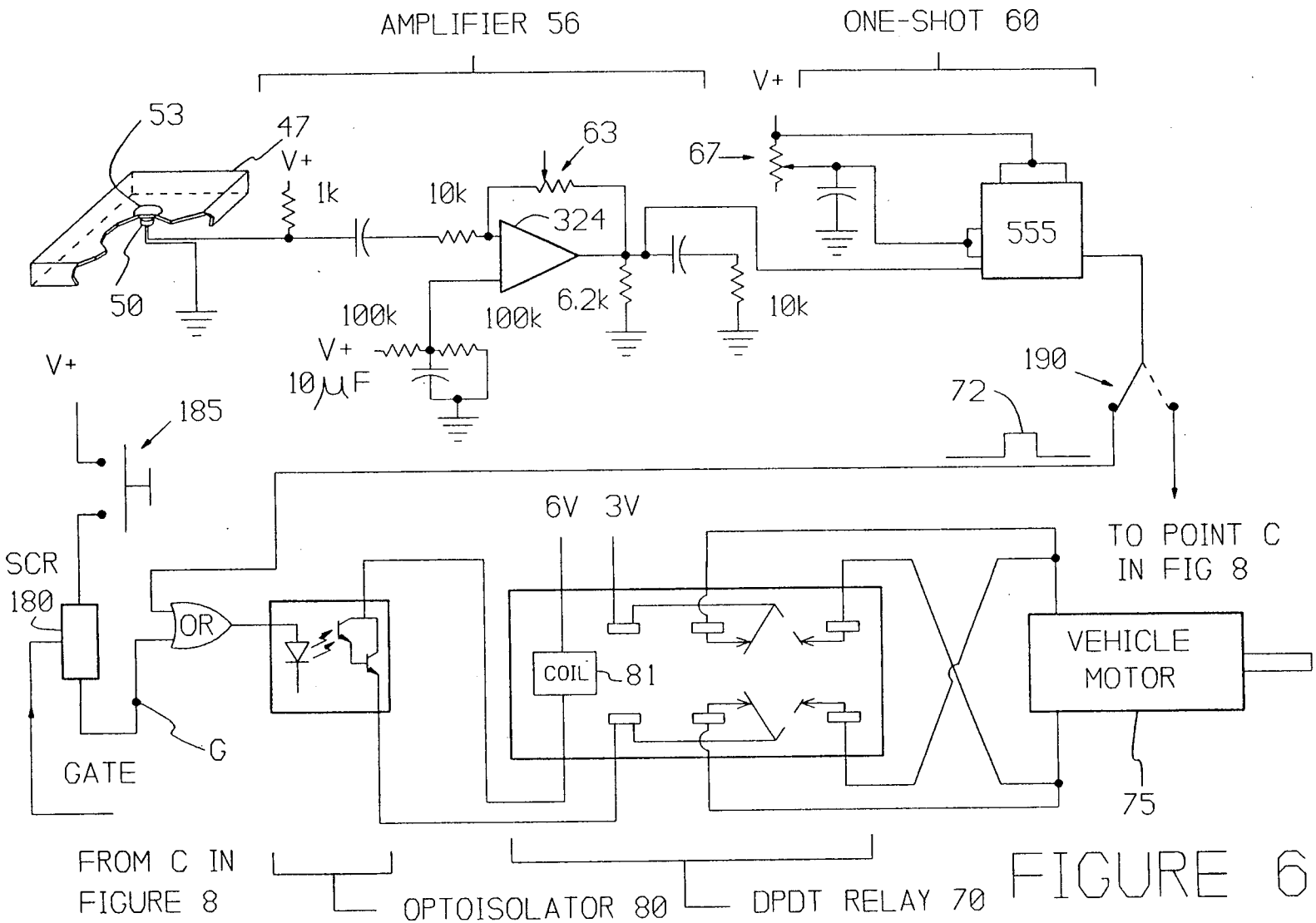
FIG. 6 illustrates electronic circuitry which detects a strike of target 9 in FIG. 1, and produces a signal 72 in response, which temporarily reverses the motor 75 of the vehicle.

A 4×6 inch clear plastic picture frame 47 in FIG. 6 was used as the target 9 in FIG. 1. The target was acoustically isolated from the vehicle 3 in FIG. 1 by foam padding (not shown) in order to isolate vehicle noise and vibration from the target. A common condenser microphone 50 in FIG. 4 such as available from Radio Shack, was affixed to the target using epoxy cement 53. An audio amplifier circuit 56 amplifies the microphone signal. The amplifier 56 used is that described on page 2–338 of National Semiconductor Corporation's Logic Databook 1, in the section devoted to type 324 op-amps. The output of the amplifier 56 was coupled to a mono-stable multivibrator (i.e., a one-shot) 60, constructed around a 555 timer. Such one shots are known in the art.

Potentiometer 63 (acting as the feedback resistor of the amplifier) is of the one-megohm type, and adjusts the gain, and thus the sensitivity, of the amplifier: a lower gain requires a harder strike by the incoming ball in order to trigger the one-shot. An amplifier gain of about 10 to 50 has produced satisfactory results.

With these components, it has been found that the one-shot is triggered only by a ball strike, and not by other noises in the room, such as talking, telephone ringing, and doorbells. Nor did the vibration and bouncing of the vehicle itself trigger the one-shot. It is believed that the plastic frame causes a significant impedance mismatch between the surrounding air and the microphone, such that airborne sounds do not easily trigger the one-shot. However, actual contact between objects and the frame, such as an incoming PING-PONG ball or the thump of one's finger, will trigger the one shot.

The duration of the one-shot's pulse 72 determines the length of time that the vehicle reverses, and potentiometer 67 controls the length of the pulse. A double-pole, double throw relay 70, actuated by the pulse 72, reverses the polarity of voltage applied to the vehicle's motor 75, and reverses the vehicle for the duration of the pulse.

The one-shot drives the relay 70 through an opto-isolator 80. The opto-isolator was used because it was found that the dc motor 75 (which drives the vehicle) produces large amounts of electrical noise which are believed to travel through the relay reeds. This noise was apparently picked up by the relay coil 81, from which it migrated to the one-shot 60 and the op-amp 56, and caused spurious triggering. The opto-isolator 80 was found to prevent this migration of motor noise.

It is noted that the isolation is complete: the relay 70 shares no common ground with the one shot, as indicated by the different ground symbols on the opto-isolator 80.

PING-PONG BALL CANNON

Figure 7:
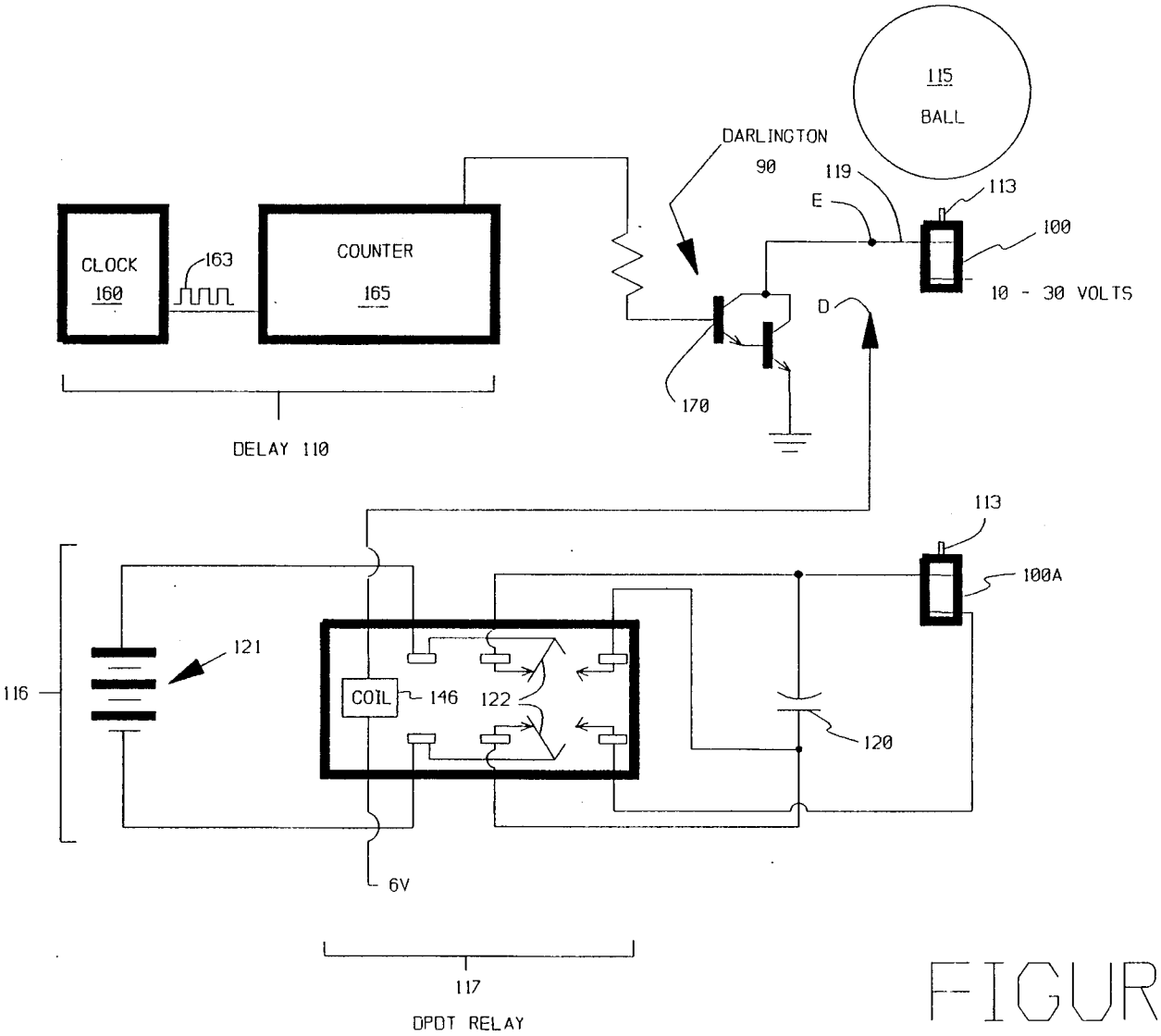
FIG. 7 illustrates a circuit for shooting a PING-PONG ball after a time delay.

The cannon 6 in FIG. 1 comprises a solenoid 100 in FIG. 7, such as that found in a common doorbell, which can be powered in two convenient ways. In one approach, a Darlington transistor pair 90 (triggered by delay circuit 110, or shot timer, later described) closes a circuit and applies 10 to 30 volts to the solenoid 100, thus causing the slug 113 to strike the ball 115, with intensity which depends on the voltage. However, since batteries of this voltage are bulky, an alternate firing system 116 is shown. In general, in the alternate, a capacitor is charged by a small battery, and then the capacitor is placed in series with the battery, to deliver current to the solenoid.

In the alternate, the coil 146 of a double throw-double pole relay 117 is connected at point E, and the solenoid 100 is disconnected from the Darlington, and re-connected to the relay 117, as shown by solenoid 100A. The Darlington now triggers the relay 117, instead of the solenoid 100. Prior to actuation of the relay, the battery 121 has charged a capacitor 120, which is in the 2,000 to 10,000 microfarad range. The battery 121 is a common battery, about 0.5×1.0×2 inches in size.

When the Darlington 90 conducts, the relay reeds 122 move into the phantom positions shown. The movement (a) disconnects the capacitor 120 from the battery 121, and then (b) places it in series with the battery, and (c) connects the series arrangement with the solenoid 100A, thus doubling the voltage applied to the solenoid, and shooting the ball 115 at this time.

SHOT TIMER

Figure 8:
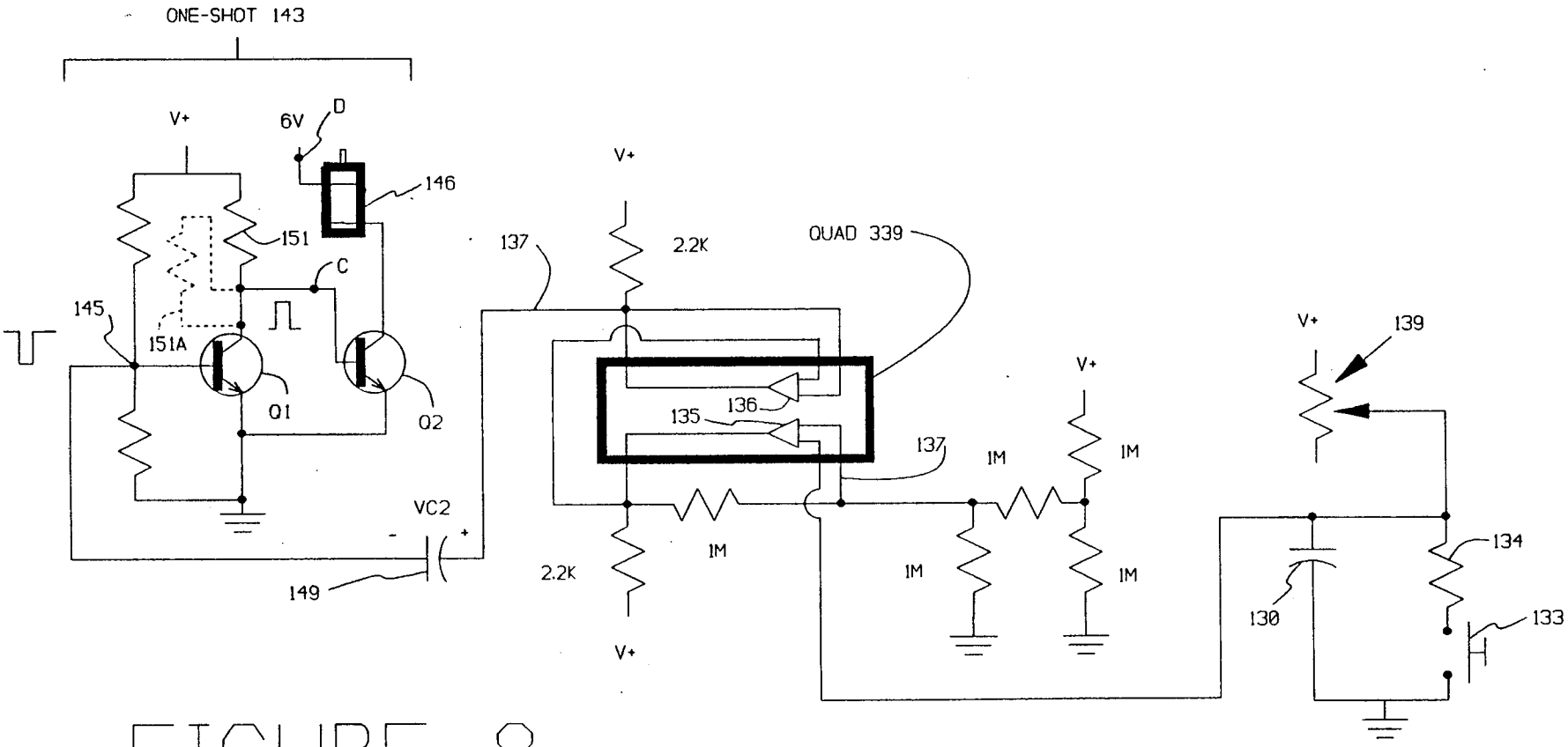
FIG. 8 illustrates a circuit for selecting a time delay, and for shooting the ball of FIG. 7 when the delay expires.

A timer 110 causes the time delay of the ball-shooting. Two convenient timer configurations are possible. First, an RC network can be used. A capacitor 130 in FIG. 8 is grounded by switch 133, through resistor 134. When the switch is released, the capacitor charges toward V+. A comparator 135 compares the capacitor voltage with a reference voltage, at point 137, and drives its output LO when the former exceeds the latter. The time needed before the comparator goes LO is the shot time delay, and the time is adjustable by virtue of potentiometer 139. Further, there is a maximum time allowed, determined by the maximum resistance which can be obtained from the potentiometer 139.

The comparator's output is fed to the input of a voltage follower, comprising comparator 136, which is used for isolation purposes. The output of the follower connects to a capacitor 149. When the output of the voltage follower goes LO, a one-shot 143, in the form of two transistors, triggers, thus triggering the coil 146, shown also in FIG. 7. The one-shot 143 is known in the art. In detail, the sequence is the following.

Prior to the comparator's triggering, the voltage at point 145, at the base of Q1, was about 1 volt. Transistor Q1 is ON, its collector voltage is LO (perhaps 0.2 volts), and transistor Q2 OFF; no current passes through the relay coil 146. A voltage Vc2 exists across the capacitor 149.

When the output of comparator 135 goes LO, the voltage follower's output also goes LO, pulling the base of transistor Q1 lower, because of the voltage across capacitor 149, thus turning Q1 OFF. Now, resistor 151 acts as a pull-up resistor and turns on transistor Q2, thus closing the relay 117 and firing the cannon. The relay 117 remains on until the charge on the capacitor 149 changes sufficiently to allow the voltage at point 145 to return to its previous value, at which transistor Q1 returns to its ON status, and transistor Q2 is OFF.

The use of a one shot has the advantage of reducing power drained from the small 9-volt battery, because both relay 117 and solenoid 100 in FIG. 7 only consume current during the one-shot's pulse. Alternately, it is possible to have the comparator 135 turn on a single transistor (not shown) directly and delivers current to the solenoid 100 and relay 117. However, in such a case, the current remains flowing until the comparator changes state, which does not occur until the switch 133 again grounds the capacitor 130.

VEHICLE RETURNS AFTER SHOOTING

For the vehicle to reverse and return to the invader after firing a shot, an SCR (Semiconductor-Controlled Rectifier) in FIG. 6 can be triggered by the pulse of one-shot 143 in FIG. 8. This triggering causes the motor 90 in FIG. 6 to drive in reverse for an indefinite period after a shot is fired. When the vehicle reaches the invader, the invader opens switch 185, which is normally closed, and located on the exterior of the vehicle. Opening this switch de-activates the SCR, de-energizes the relay coil 81, and allows the motor to resume forward operation. It is noted that this arrangement can be used irrespective of whether vehicle reversing or ball shooting is the penalty, because a ball shot always causes the and of the round.

It is possible that the current passing through the OR gate is insufficient to keep the SCR turned on. In such a case, a resistor (not shown), perhaps with dropping diodes in series to prevent interference with the OR gate, can be connected from point G to ground in order to increase the current. Alternately, the SCR can be directly connected to the motor, which draws more current than the OR gate. However, in this case, the relay reeds should be isolated from the motor at this time, because they could apply an opposite polarity. As another alternate, a flip-flop (not shown) can replace the SCR. The flip-flop is in one state when the vehicle starts up, and this state applies a logic ZERO to the OR gate. However, when the cannon shoots, pulse 72 flips the flip-flop, causing a logic ONE to be applied to the OR gate, causing the motor 75 to drive in reverse until a player re-sets the flip-flop, by a switch (not shown).

For the invader to choose between reversal and ball firing as the penalty, a switch 190 in FIG. 6 can be used. When the switch is in the position shown, the operation is as described above. When the switch is in the phantom position, the rising edge of pulse 72 in FIG. 6 (which is caused by a ball strike) now triggers the one-shot 143 in FIG. 6, firing the ball. (It is noted that, in this configuration, a resistor 151A should be connected between point C and the collector of Q1. Otherwise, point C will be held at about 0.2 volts as long as Q1 is saturated.)

Figure 14:
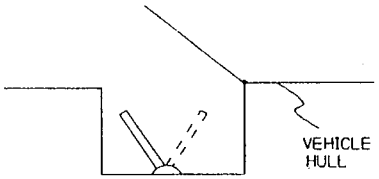
FIG. 14 shows how switch 7 in FIG. 1 can be concealed in a compartment in the vehicle, in order to prevent the other player from seeing the switch position.

It may be desired, to introduce randomness, to connect the switch 190 in FIG. 6 to point 145 instead. Now, the ball is fired on the falling edge of the pulse 72 in FIG. 6. That is, the ball shoots after a time delay: the vehicle will advance, possibly past point B in FIG. 2, and then shoot, after being struck by an incoming ball. A switch (not shown), which is concealed as shown in FIG. 14, can allow the invader to select whether the ball shot occure on the leading or trailing edge.

Alternately, a switch (not shown) can be provided which selects whether the opto-isolator 80 in FIG. 6 connects to (a) relay 70 in FIG. 6 or (b) Darlington 90 in FIG. 7. If the former is chosen, reversal occurs when a ball strikes the target 9. If the latter is chosen, involuntary shooting occurs when a ball strikes the target.

Modifications

1. In another form of the invention, the vehicle does not drive forward continuously, but jerks forward and backward, as programmed by the invader. For example, the vehicle may drive forward for two seconds, then reverse for one second, then drive forward for one second etc. The purpose of these moves is to induce the defender to throw balls at the vehicle, in the hope that, at the instant the defender releases a ball, the vehicle's direction will change, and the defender's shot will fail.

It is likely that different players will have different reflexes, so that some players can accommodate rapidly darting vehicles, while others can only accommodate slowly darting vehicles. Therefore, the time interval between motion changes should be adjustable.

Figure 9:
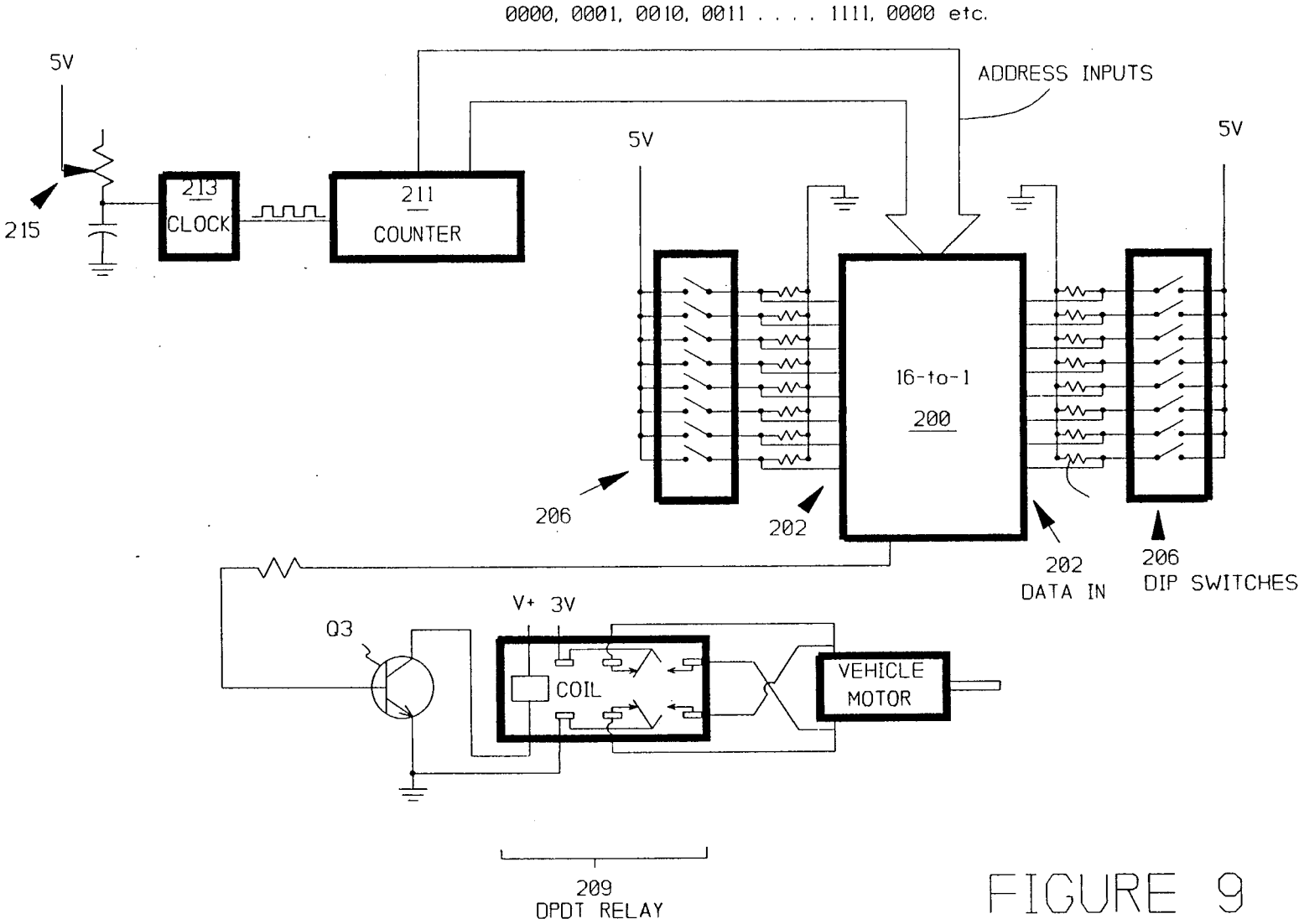
FIG. 9 illustrates a circuit for setting a sequence of forward and reverse moves to be taken by the vehicle, in order to make the vehicle more difficult to hit.

One approach to programming the vehicle is shown in FIG. 9. A 16-to-one decoder, such as the 74150 integrated circuit, is used as a memory. It has sixteen data inputs, and sixteen resistors R are connected between the inputs and ground. Thus, as so far explained, the data at each input is logic ZERO. To allow the data to be set, there are also sixteen DIP switches which can pull the data inputs to logic ONE. Thus, the 16-to-1 forms a $1\times16$ Programmable Read-Only Memory: if a DIP switch is closed, it provides a data input of ONE; if the switch is open, the input is ZERO.

The data output, DATA OUT, of the 16-to-1 connects to the coil 201 (perhaps through an amplifier, such as transistor Q3) of a DPDT relay 209. The relay determines the polarity of voltage applied to the vehicle's motor, in the manner of relay 75 in FIG. 4. In one state, the relay applies a voltage which drives the vehicle forward. In the other state, the relay applies a polarity which drives the vehicle in reverse.

Thus, when DATA OUT is ZERO, the relay is in its native, unpowered state, and the vehicle goes forward as usual. When the data out is ONE, the transistor Q3 turns ON, the relay 205 switches state, and forces the motor to operate in reverse. (It should be noted that some 16-to-1's invert the data before presenting it to the output.)

A CLOCK increments a COUNTER which presents a four-bit number to the address input of the 16-to-1. The address increments sequentially from 0000 to 1111. Accordingly, the vehicle changes direction as determined by the data present at the memory then addressed.

The CLOCK can be a 555 timer. The speed of clocking is variable by adjusting potentiometer 215, as known in the art. Preferably, the clock rate can range from a minimum of about 0.1 second per increment (giving a total time of 1.6 seconds to address all addresses of the 16-to-1) to a maximum of about 5 seconds per increment (giving a total of 80 seconds). With this adjustability, the players can select a speed of darting motion which is suitable to their levels of skill.

As an example, assume that the clock rate is 0.5 seconds, and the data at the addresses of the 16-to-1 are as shown in TABLE 1, starting with 0000. The 16-to-1 inverts the data. Thus, the sequence of vehicle directions is shown in the rightmost column of the Table, and a change occurs every 0.5 seconds. The sequence will repeat when the COUNTER in Figure reaches 0000 and starts over.

TABLE 1

| TIME | 16-to-1 ADDRESS | 16-to-1 DATA IN | 16-to-1 DATA OUT | RELAY | VEHICLE DIRECTION |
|---|---|---|---|---|---|
| 0.0 sec | 0000 | 1 | 0 | OFF | FWD |
| 0.5 | 0001 | 1 | 0 | OFF | FWD |
| 1.0 | 0010 | 1 | 0 | OFF | FWD |
| 1.5 | 0011 | 0 | 1 | ON | REV |
| 2.0 | 0100 | 0 | 1 | ON | REV |
| 2.5 | 0101 | 0 | 1 | ON | REV |
| 3.0 | 0110 | 1 | 0 | OFF | FWD |
| 3.5 | 0111 | 1 | 0 | OFF | FWD |
| 4.0 | 1000 | 1 | 0 | OFF | FWD |
| 4.5 | 1001 | 1 | 0 | OFF | FWD |
| 5.0 | 1010 | 1 | 0 | OFF | FWD |
| 5.5 | 1011 | 0 | 1 | ON | REV |
| 6.0 | 1100 | 1 | 0 | OFF | FWD |
| 6.5 | 1101 | 1 | 0 | OFF | FWD |
| 7.0 | 1110 | 1 | 0 | OFF | FWD |
| 7.5 | 1111 | 0 | 1 | ON | REV |

With this arrangement, the invader can have five parameters under his control, namely, (1) the shot delay, (2) the darting SEQUENCE (by the DIP switches), (3) the darting SPEED (i.e., the timing interval between address increments of the 16-to-1, (4) the selection of the penalty, (5) if the penalty is shooting, whether it occurs on the leading or trailing edge of pulse 72.

2. A similar type of programming can be undertaken with respect to left-right motion of the vehicle. In such a case, a solenoid or motor can be connected to the steering wheels of the vehicle. A DPDT relay, analogous to that discussed above, controls the solenoid. When the relay is OFF, the vehicle drives straight ahead. When the relay is ON, the vehicle turns to the right. Thus, a sequence of alternating STRAIGHT and RIGHT TURN moves can be programmed. Further, other means for programming a sequence of left, right, forward, and reverse moves of toy vehicles are known in the art.

Figure 15:
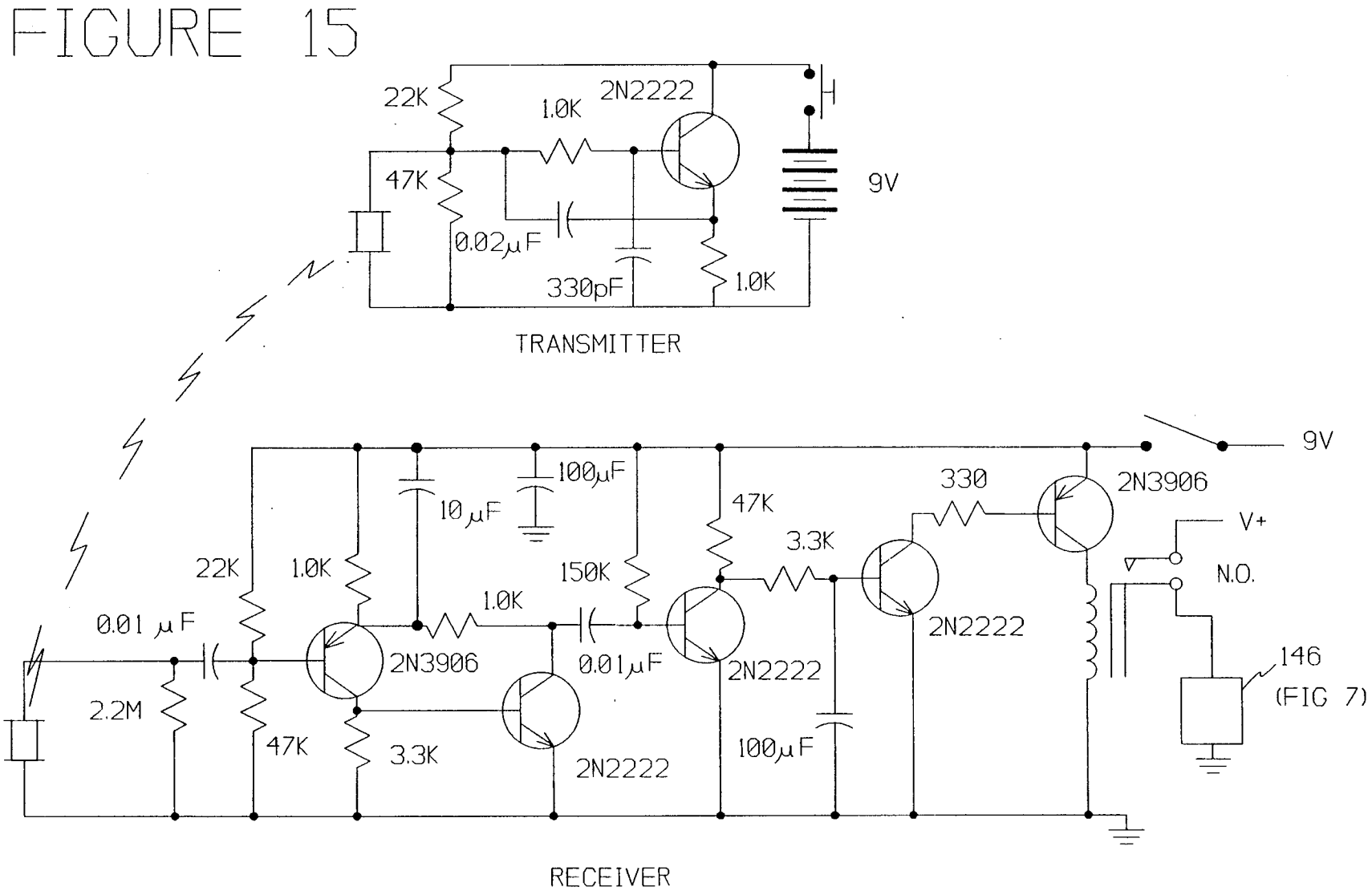
FIG. 15 illustrates an ultrasonic communications link which can be used to remotely shoot the ball cannon on the vehicle.

3. Firing of the cannon can be done by remote (wireless) control. There are numerous apparatus in the prior art which can operate a switch by wireless remote control. For example, the integrated circuits LM 1871 (Radio Control Encoder/Transmitter) and LM 1872 (Radio Control Receiver/Decoder), available from National Semiconductor Corporation, Santa Clara, Calif., can be used. Similarly, infrared or ultrasonic transmitters and receivers Can be used. For example, one type of ultrasonic link is shown in FIG. 15, which is considered self-explanatory. An infrared link is described in the parent application.

Figure 10:
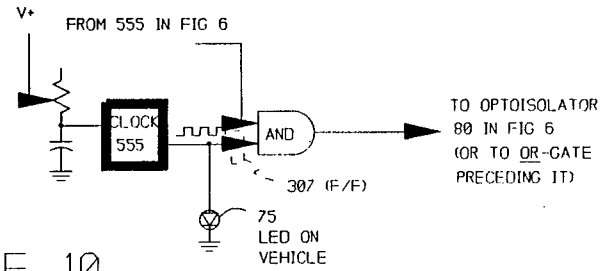
FIG. 10 illustrates a circuit for periodically deactivating the target 9 in FIG. 1.

4. The target 9 can be periodically de-activated. For example, as shown in FIG. 10, a CLOCK having an adjustable clock rate, which is adjustable by potentiometer 190, feeds one input of an AND gate. The output of the one-shot 60 in FIG. 6 feeds the other input of the AND gate. Thus, a ball strike on the target 47 in FIG. 6 can only actuate the opto-isolator 80 when the clock in FIG. 10 is HI. An LED 75, located on the vehicle, tells the defender when the target is sensitive.

The temporary de-activation of the target, as described above, can be accomplished by using a circuit identical to that in FIG. 10, but by configuring the CLOCK as a one-shot. Before the one-shot triggers, the CLOCK's output is ZERO, and so the output of the AND gate is likewise ZERO, preventing actuation of the opto-isolator. When the one-shot triggers, a flip-flop sets line 307 HI, and the AND gate now enables the one-shot 60 in FIG. 6 to actuate the opto-isolator: the target 47 is now actuated. Simultaneously, a relay (not shown) connects another resistor in series with resistor 67 in FIG. 6 in order to increase the duration of pulse 72.

Figure 11:
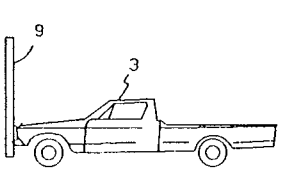
FIG. 11 illustrates positioning of the target 9 such that it can detect balls rolling on the ground.

5. The target can be positioned as shown in FIG. 11, so that it can respond to balls which roll along the ground.

6. The preceding discussion has presumed that the defender manually throws the balls by hand, or by a hand-held gun. In another form of the invention, the defender may be equipped with several stationary cannons, which he aims in advance at positions he selects. Then, when the invader begins his scoring drive, the defender actuates switches which shoot the cannons. Alternately, the defender can program each cannon with a pre-selected time delay, and, when the invader begins his scoring drive, the defender simultaneously actuates his time delays.

Figure 12:
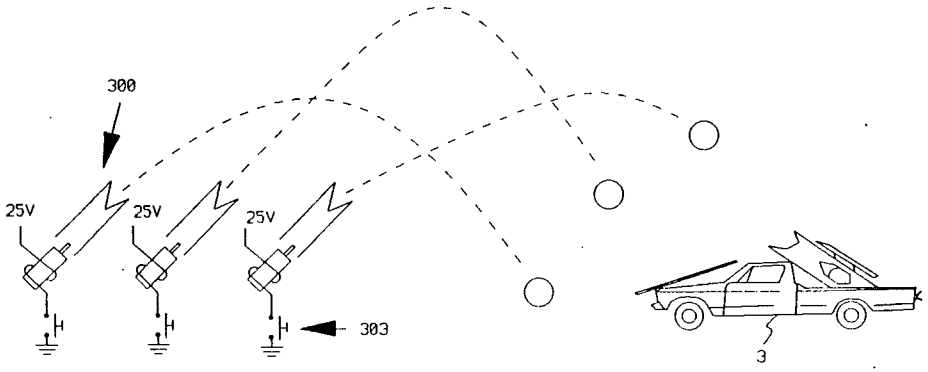
FIG. 12 illustrates a modification, in which a defender has stationary cannons which he aims in advance and then shoots at will.
Figure 13:
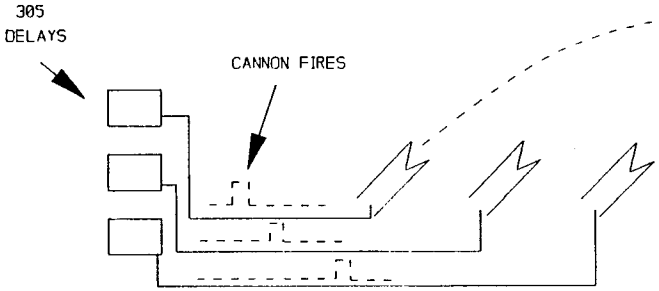
FIG. 13 illustrates a modification, in which a defender has stationary cannons which he aims in advance, and programs the sequence of shooting.

This modification is illustrated in FIG. 12. Each stationary cannon 300 can be identical to the invader's cannon, in comprising a solenoid which strikes a ping-pong ball. The defender actuates each, by switches 303, when he thinks that the vehicle is in range of the respective cannon. The actuation of the cannons 300 is done in real time. Alternately, as in FIG. 13, the defender programs a time delay 305 associated with each cannon. That is, the actuation or the cannons 300 is programmed in advance. The time delays can be identical to that described in FIG. 8. In this latter scenario, the invader programs his vehicle with a strategy he thinks proper. The invader sets (1) the shot delay, (2) the darting SEQUENCE (by the DIP switches), (3) the darting SPEED (i.e., the timing interval between address increments of the 16-to-1, (4) the selection of the penalty, (5) if the penalty is shooting, whether it occurs on the leading or trailing edge of pulse 72, (6) whether the target cycles on and off, and (7) the shooting distance of the ball cannon. The defender aims his guns and, perhaps, sets the firing sequence. Then, the players face off in a round of play.

7. It is not necessary that the object of the game be for the invader to shoot a ball past a goal. The object may be for the vehicle to reach a goal line before the cannon fires. In this case, the shot timer simply acts as a clock, but with a highly visible "alarm," namely, the ball's shooting. The defender's task is to inflict sufficient reversals on the vehicle to prevent the vehicle from attaining the goal before the cannon fires.

8. The invader can alter the shooting distance of the cannon, as by connecting additional batteries in series with the battery 121 in FIG. 7. This can be done secretly, by a rotary switch, which is concealed, as is the switch shown in FIG. 14. Further, the game can be structured so that the defender secretly sets the shooting distance, which would introduce another element of randomness.

It is significant that PING-PONG balls are used in this game. Such balls are believed to be substantially harmless to humans. "Substantially harmless" is defined as causing less damage than a ping-pong ball when dropped from a height of eight feet onto a sample target. Other light, hollow balls, are also substantially harmless.

The following U.S. Patents are hereby incorporated by reference:

U.S. Pat. No. 2,775,848 (Isaacson Jan. 1, 1957)
U.S. Pat. No. 3,065,569 (Nielsen, et al., Nov. 27, 1962)
U.S. Pat. No. 3,103,762 (Glass, et al., Sept. 17, 1963)
U.S. Pat. No. 3,811,675 (Torgow May 21, 1974) and
U.S. Pat. No. 2,474,054 (Jones Jun. 21, 1949).

Numerous substitutions and modifications can be undertaken in construction of apparatus which perform the functions described herein. For example, it must be recognized that many of the functions described herein, such as shooting the ball and selecting a shot delay, can be accomplished my mechanical mechanisms, known in the art.

What is desired to be secured by Letters Patent is the invention as defined in the following claims.

I claim:

1. A toy, comprising:

a) a self-propelled vehicle;

b) a gun on the vehicle which shoots a substantially harmless projectile; and c) means for causing the gun to shoot after a predetermined, selectable time delay.

2. Apparatus according to claim 1 and further comprising:

d) means for sensing a strike by an incoming missile, and producing a signal in response; and e) means for altering behavior of the vehicle in response to the signal.

3. Apparatus according to claim 1 and further comprising:

d) means for sensing a strike by an incoming airborne missile, and producing a signal in response;

e) means for allowing a player to select, in advance, which of two or more responses the vehicle takes in response to the signal.

4. Apparatus according to claim 1 and further comprising:

d) means for sensing a strike by an incoming airborne missile, and producing a signal in response;

e) means for altering the vehicle's motion in response to the signal; and e) programming means for allowing a player to program a sequence of moves which the vehicle takes.

5. Apparatus according to claim 1 and further comprising:

c) means for firing the cannon in response to a remotely transmitted signal sent by a player.

6. Apparatus according to claim 1 and further comprising:

c) sensor means for detecting a strike by an airborne object; and d) penalty means for altering operation of the vehicle in response to the strike.

7. Apparatus according to claim 1 and further comprising d) means for causing the vehicle to alternately move forward and reverse, in order to increase difficulty of being hit by a missile.

8. Apparatus according to claim 1 and further comprising d) means for causing the vehicle to drive toward its origin when after the gun shoots.

9. A game, comprising:

a) a self-propelled vehicle;

b) a target on the vehicle which detects a strike by an incoming missile, and produces a signal in response;

c) means for altering the vehicle's motion in response to the signal; and d) one or more stationary guns which shoot said incoming missiles in response to commands by a player.

10. A game according to claim 9 in which said commands are programmed in advance.

11. A game according to claim 9 in which said commands are given in real-time.

12. Apparatus according to claim 9 and further comprising:

e) means for causing the vehicle to follow a non-continuous path, for making strikes by the airborne objects more difficult.

13. A game, comprising:

a) a toy vehicle which is self-powered and comprises:

i) a gun which shoots a projectile which is substantially harmless to humans;

ii) a timer which shoots the gun after a pre-selected time delay;

iii) sensor means for detecting incoming airborne projectiles, and modifying vehicle operation in response to said detection;

iv) means for causing the vehicle to return to its origin after the gun shoots;

b) a goal for the vehicle to approach and shoot the gun toward;

c) a plurality of missiles for a defending player to launch toward the sensor means, for causing said modifying of vehicle operation.

14. A toy, comprising:

a) a vehicle which is self powered;

b) means for instructing the vehicle to make a programmed sequence of moves; and c) sensor means for sensing whether an incoming object strikes the vehicle, and modifying vehicle movement in response.

* * * * *